US005366104A

United States Patent [19]

Armstrong

[11] Patent Number: 5,366,104

[45] Date of Patent: Nov. 22, 1994

[54] CONTAINER WITH HINGED LID

[75] Inventor: David R. Armstrong, Otsego, Mich.

[73] Assignee: Fabri-Kal Corporation, Kalamazoo, Mich.

[21] Appl. No.: 120,677

[22] Filed: Sep. 13, 1993

[51] Int. Cl.[5] ..... B65D 43/16

[52] U.S. Cl. ..... 220/339; 220/306; 220/4.22; 220/4.23

[58] Field of Search ..... 220/264, 281, 306, 307, 220/335, 337, 339, 355, 356, 4.22, 4.23; 206/45.32

[56] References Cited

U.S. PATENT DOCUMENTS

| | | | |
|---|---|---|---|
| 3,320,993 | 5/1967 | Motsenbocker | 220/306 |
| 3,876,130 | 4/1975 | Haase | 220/4.23 |
| 4,013,214 | 3/1977 | Hansen et al. | 220/4.22 |
| 4,298,133 | 11/1981 | Davis | 220/339 |
| 4,535,889 | 8/1985 | Terauds | 220/307 |
| 4,742,934 | 5/1988 | Michaud et al. | 220/306 |
| 4,836,407 | 6/1989 | Bruce et al. | 220/276 |
| 4,971,220 | 11/1990 | Kaufman et al. | 220/335 |
| 5,012,928 | 5/1991 | Proffitt et al. | 220/359 |
| 5,036,997 | 8/1991 | May et al. | 220/335 |
| 5,131,551 | 7/1992 | Wells | 220/307 |
| 5,204,130 | 4/1993 | McDevitt et al. | 220/339 |
| 5,242,696 | 9/1993 | McDevitt | 220/339 |

*Primary Examiner*—David T. Fidei

*Attorney, Agent, or Firm*—Flynn, Thiel, Boutell & Tanis

[57] ABSTRACT

A container which includes a base and a lid connected together at a common juncture defining a hinge. The base has a bottom wall, an upstanding sidewall connected to the bottom wall with the hinge being oriented along a region adjacent an upper edge of the sidewall. A first flange extends generally laterally from at least opposite ends of the hinge and outwardly from the sidewall adjacent the upper edge of the sidewall. The first flange includes an upwardly facing surface. The lid has a top wall and a downwardly depending skirt connected to the top wall and extending at a perimeter thereof at least laterally from the opposite ends of the hinge outside of and in close proximity to the first flange. The skirt has a lower edge which, in a closed position of a lid, terminates at a position below the first flange. The lower edge, in an open position of the lid, is oriented above and rests on the upwardly facing surface of the first flange so as to releasably hold the lid in a predetermined open position.

7 Claims, 5 Drawing Sheets

CONTAINER WITH HINGED LID

FIELD OF THE INVENTION

This invention relates to a container having a base and an openable and closeable lid hingeably connected to the base and, more particularly, to a container wherein the lid can be moved to and retained in an open position.

BACKGROUND OF THE INVENTION

The invention disclosed herein is related to the subject matter of U.S. Pat. Nos. 4,971,220 and 5,036,997.

This invention arose out of a need to provide a further improvement to containers used to package and dispense baby wet wipes, particularly containers which include structure for retaining the lid in an open condition. The problem heretofore has been that lids tend to fall completely or nearly closed by themselves. Since users of baby wipes frequently require more than one wipe, it is necessary to essentially reopen the container to remove successive wipes. When one hand of the user is usually serving to maintain the baby on a support surface, such as a diaper changing table, only one hand is free to effect an opening of the baby wet wipe container. If the container lid is at least close to being closed (i.e., partially open), one hand of the user is often inadequate to effect an opening of the container to a sufficient extent so as to allow convenient access of the user's hand to the interior of the container.

Accordingly, it is an object of this invention to provide a container having a base and an openable and closeable lid wherein the lid is adapted to be retained in a near fully open position so as to provide free and unencumbered access to the interior of the container.

It is a further object of the invention to provide a container, as aforesaid, wherein the lid is retained in the open position thereof at an angle of about 60° to 90° relative to the base.

It is a further object of the invention to provide a container, as aforesaid, wherein the retention of the lid in the open position is easily engaged and disengaged to facilitate a convenient use of the container.

It is a further object of the invention to provide a container, as aforesaid, wherein both the base and the lid are made of a moldable synthetic resin and having a uniform wall thickness throughout.

It is a further object of the invention to provide a container, as aforesaid, wherein the region of the upper edge of the container and the conforming construction on the lid which effects a sealing of the interior of the container effects an effective seal when the lid is in the closed position.

It is a further object of the invention to provide a container, as aforesaid, which is durable in its construction and is easily manufactured so as to be virtually free of tolerance considerations.

SUMMARY OF THE INVENTION

In general, the objects and purposes of the invention are met by providing a container which includes a base and a lid connected together at a common juncture defining a hinge. The base has a bottom wall, an upstanding sidewall connected to the bottom wall with the hinge being oriented adjacent an upper edge of a region defining a rear sidewall. A first flange extends generally laterally from at least opposite ends of the hinge and outwardly from the sidewall adjacent the upper edge of the sidewall and forwardly of the base from the hinge area. The first flange includes an upwardly facing surface. The lid has a top wall and a downwardly depending skirt connected to the top wall and extending at a perimeter thereof at least laterally from the opposite ends of the hinge outside of and in close proximity to the first flange. The region of the skirt adjacent opposite ends of the hinge has a lower edge which, in a closed position of a lid, terminates at a position below the first flange. The lower edge, in an open position of the lid, is oriented above and rests on the upwardly facing surface of the first flange so as to releasably hold the lid in a predetermined open position.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 2:
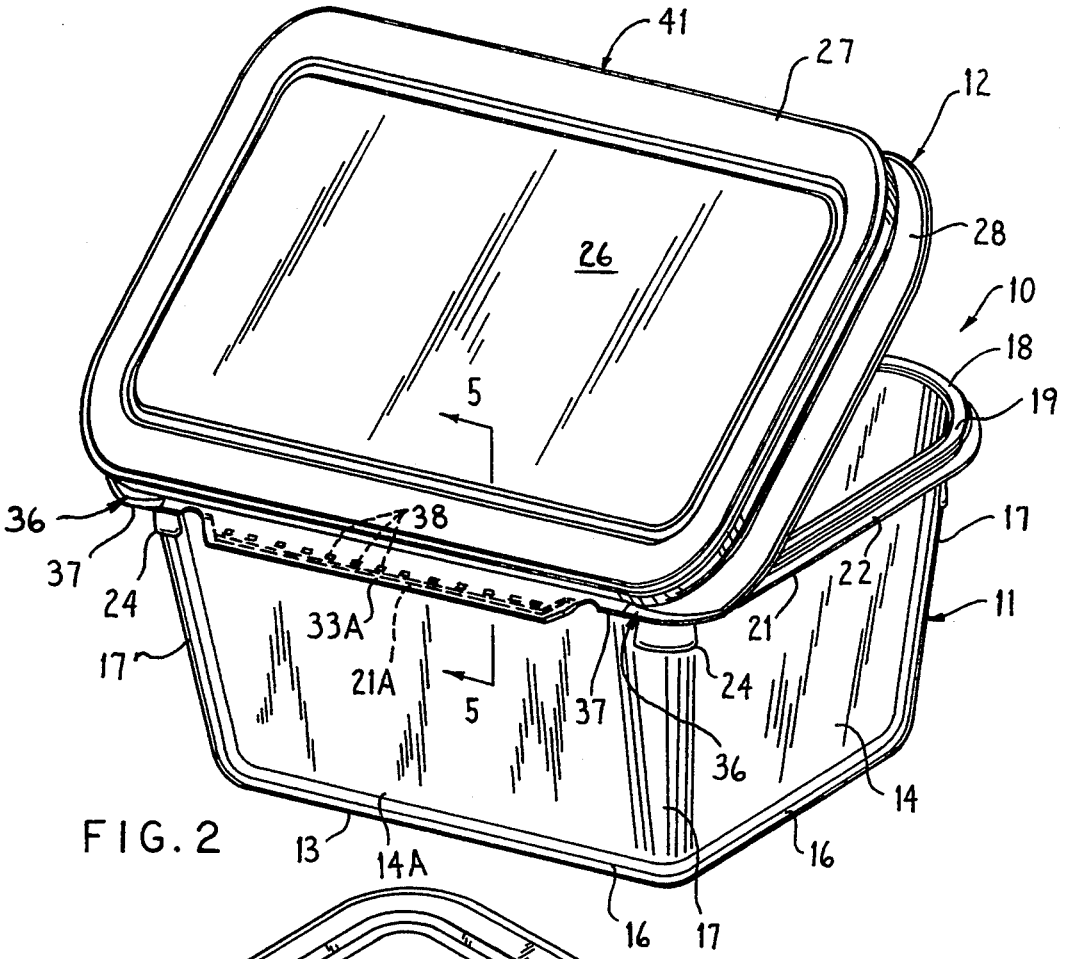
FIG. 2 is a perspective view of an open condition of the container embodying the invention.
Figure 1:
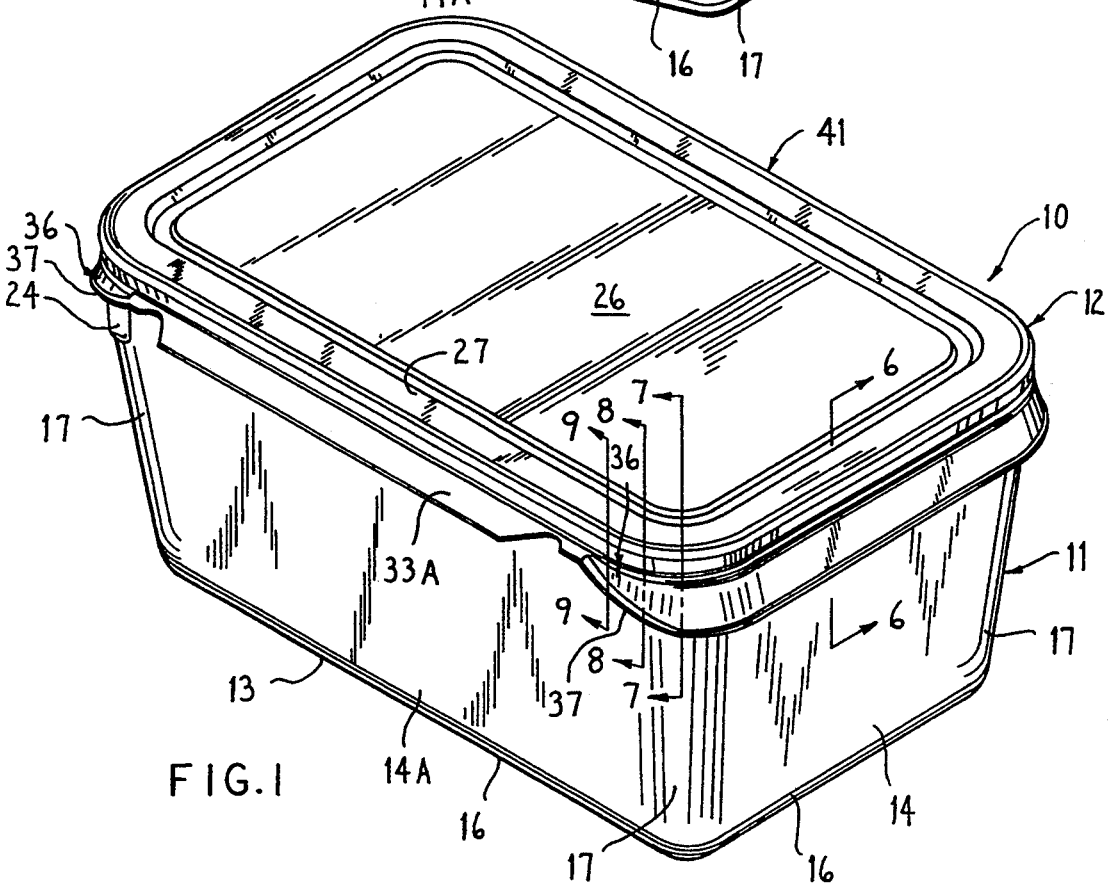
FIG. 1 is an isometric view of a closed container and lid combination embodying the invention.

FIGS. 1–4 show a container 10 embodying the invention. The container 10 includes a base 11 and an openable and closeable lid 12 hingeably mounted on the base 11. The base includes a bottom wall 13 and a plurality of upstanding sidewalls 14 and a rear sidewall 14A connected to the bottom wall 13.

The bottom wall 13 is secured to each of the sidewalls 14 and 14A through a radiused or curved section 16. Similarly, the sidewalls 14 and 14A are connected to each other through a similarly radiused or curved section 17. The upper edge 18 of each of the sidewalls 14 and 14A, including the radiused sections 17 includes a rolled over section 19, in the form of an inverted U, terminating at an outboard edge thereof in a first flange 21 which extends outwardly away from the outboard edge and has a generally upwardly facing surface 22 thereon. The outward extent of a first flange 21A relative to the outboard edge of the rolled over section 19 on the rear sidewall 14A (FIG. 5) is greater than the extent of the first flange 21 on the remaining walls of the container 10. The purpose of this construction will become apparent below. The juncture between the first flange 21, 21A and the outboard edge of the rolled over section 19 projects inwardly so as to define a peripherally extending recess 23. The purpose of the recess 23 will become apparent below.

Conventional stacking lugs 24 are provided in each of the radiused sections 17 transitioning the sidewalls 14 and 14A, namely, in each of the four corners of the base 11 and serve to prevent a stacked array of base members 11 from becoming compressed together when stacked. In other words, the stacking lugs 24 will maintain a specific spacing between the sidewalls 14 and 14A of the mutually adjacent base members 11 so as to allow air to enter the aforesaid space and facilitate a removal of one base member 11 from within the next mutually adjacent base member.

Figure 6:
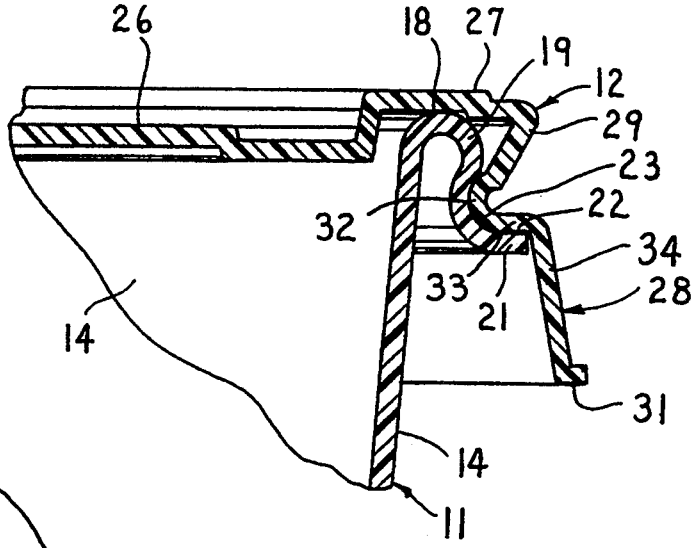
FIG. 6 is a sectional view taken along the line 6—6 of FIG. 1.

The lid 12 includes a top wall 26 having a raised peripherally extending rim section 27 contiguous with the top wall section 26 and a downwardly depending skirt section 28 contiguous with the rim section 27. More specifically, the skirt section 28 includes a top edge portion 29 that is contiguous with the rim section 27 and a lower edge portion 31 oriented externally of and below the level of the first flange 21 as illustrated in FIG. 6. Intermediate the top edge 29 and the lower edge 31 is an inwardly extending rib 32 having an inwardly facing surface that conforms to the outwardly facing surface of the peripherally extending recess 23. A lower region of the rib 32 extends through an outwardly extending flange section 33 that is generally parallel to the outwardly extending first flange 21 (FIG. 6). A downwardly extending section 34 is connected to and extends between the outer portion of the outwardly extending flange section 33 and the lower edge portion 31 of the skirt 28.

Figure 3:
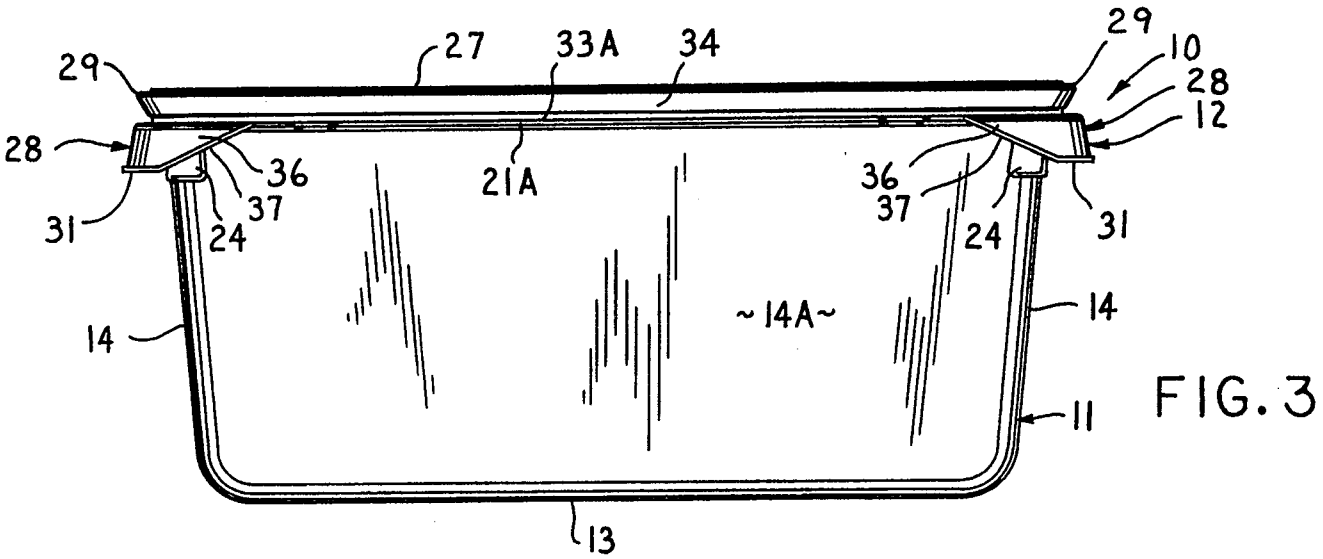
FIG. 3 is a rear view of the container and lid.
Figure 4:
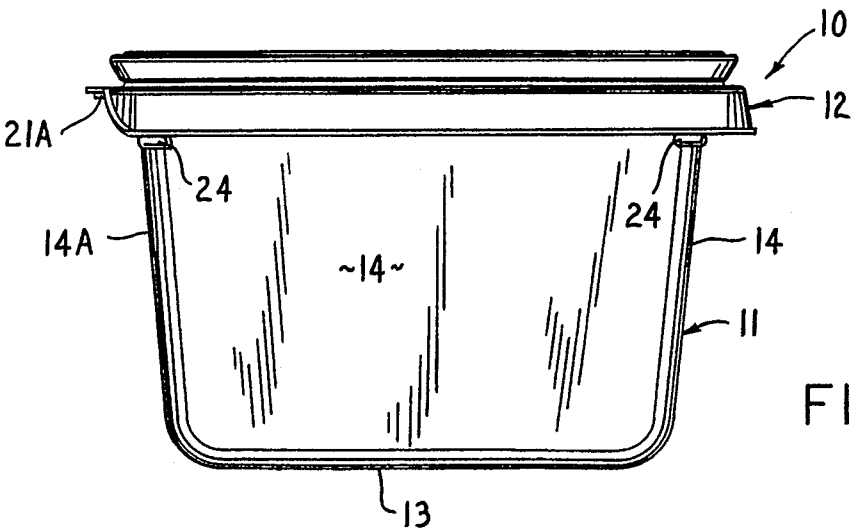
FIG. 4 is a side view of the container and lid.

The rear edge portion 34 of the lid 12 is altered slightly as illustrated in FIG. 3 and from the construction described above and shown in FIG. 6. More specifically, the rear edge portion 34 does not have a complete skirt 28 as do the remaining three edge portions of the lid 12. The bottom edge 31 of the left and right side skirts 28 shown in FIG. 3 is connected through a pair of transition sections 36 to the outwardly extending flange section 33 which has a greater width as at 33A (FIG. 5) than the outwardly extending flange sections 33 shown in FIG. 6. As illustrated in FIG. 3, the transition sections 36 extend in opposite directions away from the outwardly extending flange section 33A to tie into the lower portion of the skirts 28. That is, each transition section 36 includes an outwardly facing a lower edge portion 37 that is inclined to a plane containing the top wall 26 and extends outwardly of the outer extremity of the flange 21 and downwardly and laterally outwardly from the outwardly extending section 33 to provide an interconnection between the aforesaid outwardly extending flange section 33 immediately adjacent the extended width portion 33A and the lower edge portions 31 on the associated skirts 28 mutually adjacent thereto.

The outwardly extending section 33A on the rear portion of the lid 12 is secured to the upwardly facing surface 22 of the altered first flange 21A as at 38 so as to define a hinge 39 extending along the lateral length of the interconnected outwardly extending flange section 33A and flange 21A. The aforesaid connection 38 can be by any convenient means, such as welding.

When the lid 12 is in the closed position as illustrated in FIGS. 1, 3, 4 and 6, the inwardly projecting rib 32 is received in the peripherally extending recess 23 and the upper surface of the rolled over section 19 engages the downwardly facing surface of the rim section 27 so as to form a seal. Additional sealing occurs between the outwardly extending flange sections 33, 33A and the upwardly facing surface 22 on the first flanges 21, 21A. Thus, the moisture content of any wet wipe product that may be oriented within the interior of the base 11 is retained and will not evaporate when the lid 12 is in the closed position.

Figure 5:
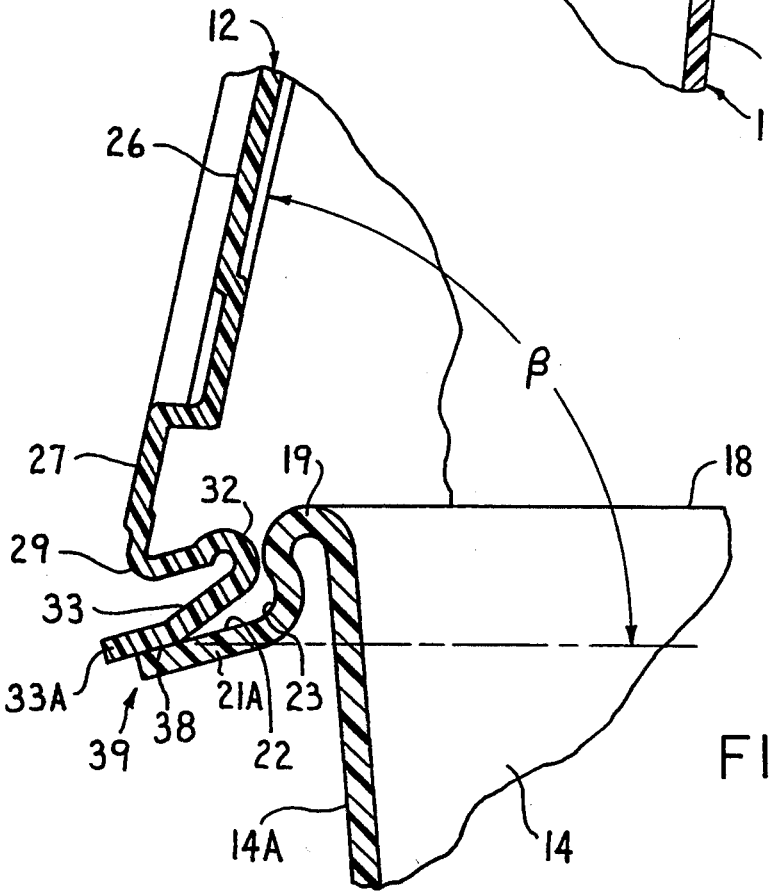
FIG. 5 is a sectional view taken along the line 5—5 of FIG. 2.
Figure 7:
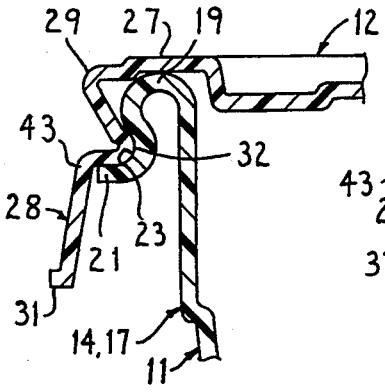
FIG. 7 is a sectional view taken along the line 7—7 of FIG. 1.
Figure 8:
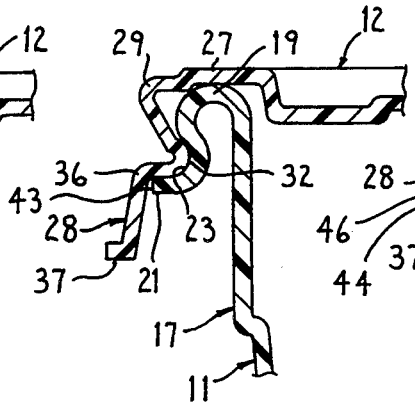
FIG. 8 is a sectional view taken along the line 8—8 of FIG. 1.
Figure 9:
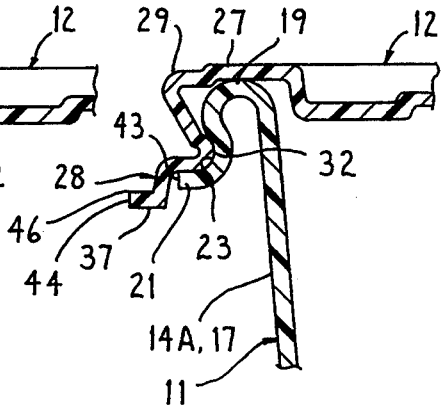
FIG. 9 is a sectional view taken along the line 9—9 of FIG. 1.
Figure 7A:
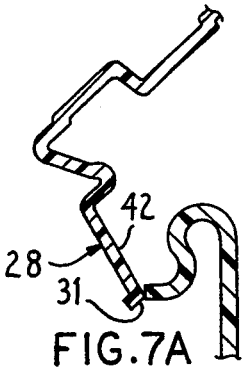
FIGS. 7A–7C are sectional views taken along the line 7—7 of FIG. 1 and representing various stages of movement of the illustrated section of the lid relative to the upper edge of the base.
Figure 8A:
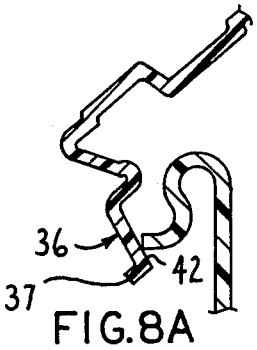
FIGS. 8A–8C are sectional views taken along the line 8—8 of FIG. 1 and representing various stages of movement of the illustrated section of the lid relative to the upper edge of the base.
Figure 9A:
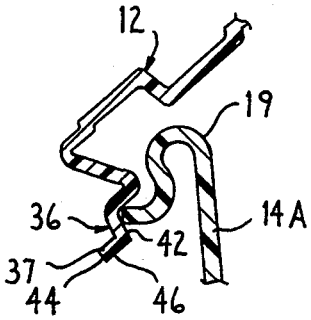
FIGS. 9A–9C are sectional views taken along the line 9—9 of FIG. 1 and representing various stages of movement of the illustrated section of the lid relative to the upper edge of the base.
Figure 7B:
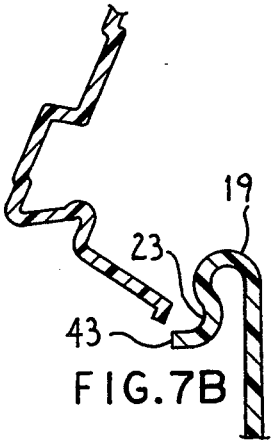
Figure 8B:
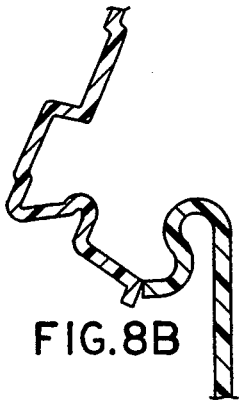
Figure 9B:
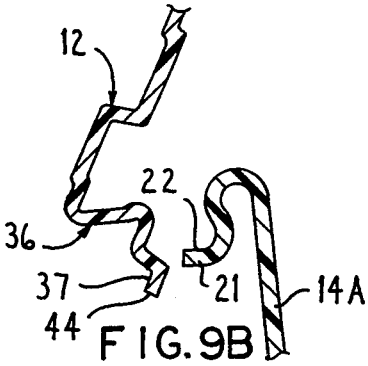
Figure 7C:
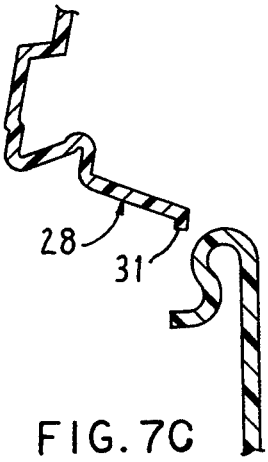
Figure 8C:
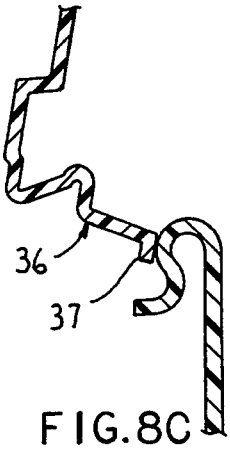
Figure 9C:
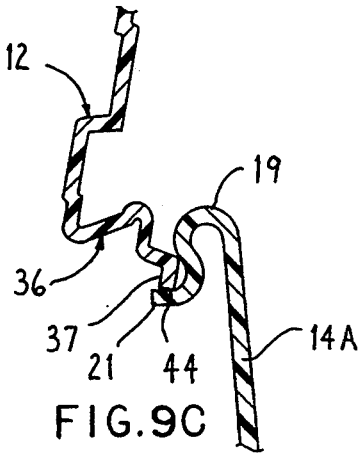

FIGS. 7–9 illustrate three sectional views through the radiused section 17 joining a sidewall 14 to the rear sidewall 14A and through the lid 12 in the closed position. When it is deemed time to move the lid 12 to an open position, such as is illustrated in FIGS. 2 and 5, the user will lift up on the skirt 28 at the front portion 41 of the lid 12, namely, that portion which is on a side of the lid 12 remote from the hinge 39. A vertical upward force applied to the skirt 28 will be sufficient to move the rib 32 out of the peripheral recess 23 to facilitate a lifting of the lid 12 about the axis of the hinge 39 defined by plural laterally spaced welds 38 (FIG. 2). FIGS. 7A–7C, FIGS. 8A–8C and FIGS. 9A–9C show the sequential relative movement between the skirt 28 and transition section 36 relative to the first flange 21. Generally, an inside facing wall surface 42 of the skirt 28 and transition section 36 slidingly engages the outwardly facing edge 43 of the first flange 21. When the lid reaches the fully open position illustrated in FIGS. 2, 5 and 9A–9C, the lid 12 will be retained in the nearly fully open position (FIG. 9C) by the engagement of the lower edge portion 37 of the transition section 36, particularly an outwardly facing edge surface 44 on a second flange segment 46 on the lower edge portion 37 with the upwardly facing surface 22 of the first flange 21. Generally, the lid, in the nearly open position, will define an angle $\beta$ with the base 11 that is in the range of 60° to 90°. Preferably, however, the angle $\beta$ will be in the range of 70° to 85°. This degree of openness of the lid 12 relative to the base 11 will provide ample access for the user to access product within the base, such as baby wet wipes. When it is desired to close the container, the user merely needs to apply a closing force adjacent the front edge 41 of the lid 12 so that a reverse movement of the lid relative to the base will occur such as is illustrated in FIGS. 9A–9C, FIGS. 8A–8C, FIGS. 7A–7C and FIGS. 7–9, respectively.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined follows:

1. A container comprising a base and a lid connected together at a common juncture defining a hinge, said base having a bottom wall, an upstanding sidewall connected to the bottom wall, said hinge being oriented along a region adjacent an upper edge of said sidewall, and a first flange extending generally laterally from at least opposite ends of said hinge and oriented adjacent said upper edge of said upstanding sidewall and extending outwardly from said sidewall, said first flange having an upwardly facing surface, said lid having a top wall and a downwardly depending skirt connected to said top wall and extending at a perimeter of said top wall at least laterally from said opposite ends of said hinge outside of and in close juxtaposition to said first flange, said skirt solely adjacent opposite ends of said hinge having an externally facing lower edge inclined to a plane containing said top wall which, in a closed position of said lid, terminates outside of and at a position below said first flange, said lower edge, in an open position of said lid, becoming oriented above and resting on said upwardly facing surface of said first flange so as to releasably hold said lid in a predetermined open position.

2. The container according to claim 1, wherein said base and said lid are made of a moldable synthetic resin having a uniform wall thickness.

3. The container according to claim 1, wherein said lower edge of said skirt includes an outwardly extending second flange terminating in an outwardly facing surface when said lid is in said closed position; and wherein said outwardly facing surface becomes a generally downwardly facing surface, when said lid is in a fully open position, and opposes said upwardly facing surface on said first flange.

4. The container according to claim 3, wherein an angle of the lid relative to the base, when said lid is in said fully open position, is from 60° to 90°.

5. The container according to claim 3, wherein an angle of the lid relative to the base, when said lid is in said fully open position, is from 70° to 85°.

6. The container according to claim 3, wherein said base and said lid are separately molded components secured to one another at said common juncture defining said hinge; and wherein said hinge includes a hinge axis.

7. The container according to claim 6, wherein said base has at least four generally perpendicularly related sidewalls and four rounded corner sections connecting said sidewalls to one another, two of said rounded corners being located at said opposite ends of said hinge;

wherein two of said four rounded corner sections include an extension of said second flange;

wherein said skirt on said lid includes at least a pair of rounded corner sections opposing said two of said four rounded corner sections at said opposite ends of said hinge on said base, said lower edge of said skirt at each of said pair of rounded corner sections including an inclined flange section extending outwardly from said skirt and between a level of said hinge downwardly and away from the other of said pair of rounded corner sections to a level below said hinge when said lid is in the closed position, said inclined sections each having said outwardly facing surface thereon which is moved about said hinge as said lid is moved toward said fully open position to cause said outwardly facing surface to slide up over said first flange to eventually bring all of said outwardly facing surface above said upwardly facing surface of said first flange, when said lid is in a fully open position, so that the outwardly facing surface, now a generally downwardly facing surface, rests on said upwardly facing surface to hold said lid in a predetermined open position.

* * * * *